US008672711B2

(12) United States Patent
Kondo et al.

(10) Patent No.: US 8,672,711 B2
(45) Date of Patent: Mar. 18, 2014

(54) CONNECTOR INCLUDING A SHIELD CASE AND A CONTACT AT LEAST A PART OF THE CONTACT ADJACENT TO A PART OF THE SHIELD CASE

(75) Inventors: Hayato Kondo, Yao (JP); Kenji Miki, Yao (JP)

(73) Assignee: Hosiden Corporation, Yao-shi (JP)

( * ) Notice: Subject to any disclaimer, the term of this patent is extended or adjusted under 35 U.S.C. 154(b) by 548 days.

(21) Appl. No.: 12/948,155

(22) Filed: Nov. 17, 2010

(65) Prior Publication Data

US 2011/0159732 A1 Jun. 30, 2011

(30) Foreign Application Priority Data

Dec. 25, 2009 (JP) ..... 2009-293745

(51) Int. Cl.
*H01R 13/648* (2006.01)

(52) U.S. Cl.
USPC ..... 439/607.4; 439/607.1; 439/607.11

(58) Field of Classification Search
None
See application file for complete search history.

(56) References Cited

U.S. PATENT DOCUMENTS 6,575,789 B2 * 6/2003 Bassler et al. ..... 439/607.23
7,850,477 B2 * 12/2010 Koyama et al. ..... 439/358
7,946,887 B1 * 5/2011 Zhang et al. ..... 439/607.23
8,011,959 B1 * 9/2011 Tsai et al. ..... 439/607.25
8,011,960 B2 * 9/2011 Xiao et al. ..... 439/607.56
2003/0017730 A1 1/2003 Bassler et al. ..... 439/108
2010/0317229 A1 * 12/2010 Chen et al. ..... 439/607.23

FOREIGN PATENT DOCUMENTS

EP 2 015 402 A2 1/2009
EP 2 120 299 A2 11/2009
JP 2009-277497 A1 11/2009

OTHER PUBLICATIONS

European Search Report dated Mar. 2, 2011 for the counterpart European patent application No. 10252216.6.

* cited by examiner

*Primary Examiner* — Michael Zarroli
(74) *Attorney, Agent, or Firm* — Kratz, Quintos & Hanson, LLP

(57) ABSTRACT

The invention provides a connector including a body having insulating properties, a conductive shield case surrounding the body, and a first terminal group arrayed in a line in the body. The first terminal group includes a first terminal and a second terminal. The second terminal is disposed adjacent to the first terminal and having a higher impedance than the first terminal. The shield case includes an adjacent portion that is adjacent to at least a portion of the second terminal and on an opposite side to the first terminal. At least one of the portion of the second terminal and the adjacent portion of the shield case is extended in width so as to shorten a distance between the portion of the second terminal and the adjacent portion of the shield case in accordance with an impedance difference between the first terminal and the second terminal.

9 Claims, 8 Drawing Sheets

CONNECTOR INCLUDING A SHIELD CASE AND A CONTACT AT LEAST A PART OF THE CONTACT ADJACENT TO A PART OF THE SHIELD CASE

The present application claims priority under 35 U.S.C. §119 of Japanese Patent Application No. 2009-293745 filed on Dec. 25, 2009, the disclosure of which is expressly incorporated by reference herein in its entity.

BACKGROUND OF THE INVENTION

1. Technical Field

The present invention relates to connectors with a plurality of terminals.

2. Background Art

A conventional connector of this type is a receptacle connector having first and second terminal groups, a body in which the first and second terminal groups are arrayed in lines flush with each other, and a conductive shield case for covering the body, as disclosed in Japanese Unexamined Patent Publication No. 2009-277497. The first terminal group complies with the USB 3.0 standards, and the second terminal group complies with the USB 2.0 standards. The first terminal group has a TX− signal terminal, a TX+ signal terminal, a GND terminal, an RX− signal terminal, and an RX+ signal terminal arrayed in a line in this order.

CITATION LIST

Patent Literature 1: Japanese Unexamined Patent Publication No. 2009-277497

SUMMARY OF INVENTION

The nonexistence of terminals next to one side of the TX− signal terminal or next to the other side of the RX+ signal terminal causes the increase of the impedances of the TX− signal terminal and the RX+ signal terminal. Time differences (skew) thus occur in signal transmission to the TX− signal terminal and the TX+ signal terminal, and common mode noise superimposed on the TX− signal terminal and the TX+ signal terminal may have asymmetric effects. The common mode noise thus cannot be canceled at the receiver of the signal, which is a factor in degrading high frequency characteristics. This problem holds true for the other differential pair of the RX− signal terminal and the RX+ signal terminal.

Further, increased impedances of the TX− signal terminal and the RX+ signal terminal causes increase in impedance of the entire receptacle connector. This results in mismatched impedance characteristics between the transmission path (first terminal group) of the receptacle connector and a transmission path outside the connector (e.g., terminal group of a mating plug connector or signal lines of a circuit board equipped with the receptacle connector). This mismatch becomes a factor in reflecting the high speed signals transmitted on the transmission paths and further causes the degradation of the transmission characteristics.

It is obviously possible to reduce impedances of the TX− signal terminal and the RX+ signal terminal by providing dummy GND terminals next to the one side of the TX− signal terminal and next to the other side of the RX+ signal terminal. However, this solution increases the number of components and complicate the entire configuration of the receptacle connector.

In view of the above circumstances, the present invention provides a connector with a simple configuration and adapted to match impedances between the terminals subject to impedance adjustment.

A connector according to a first aspect of the present invention includes: a body having insulating properties; a conductive shield case surrounding the body; and a first terminal group arrayed in a line in the body. The first terminal group includes a first terminal and a second terminal. The second terminal is disposed adjacent to the first terminal and having a higher impedance than the first terminal. The shield case includes an adjacent portion that is adjacent to at least a portion of the second terminal and on an opposite side to the first terminal. At least one of the portion of the second terminal and the adjacent portion of the shield case is extended in width so as to shorten a distance between the portion of the second terminal and the adjacent portion of the shield case in accordance with an impedance difference between the first terminal and the second terminal.

In the connector according to the first aspect, at least one of the portion of the second terminal and the adjacent portion of the shield case is extended in width so as to shorten a distance between the portion of the second terminal and the adjacent portion of the shield case in accordance with an impedance difference between the first terminal and the second terminal, so that the adjacent portion of the shield case functions as a pseudo-GND terminal. Advantageously, the invention makes it possible to lower the impedance of the second terminal without adding a dummy GND terminal. The impedance matching can be thus conducted between the first and second terminals.

When the adjacent portion is adjacent to the entire second terminal, at least one of the second terminal and the adjacent portion of the shield case may be extended in width so as to shorten a distance between the second terminal and the adjacent portion of the shield case in accordance with the impedance difference between the first terminal and the second terminal. This case also produce the same effect as the connector according to the first aspect.

A connector according to a second aspect of the present invention includes: a body having insulating properties; a conductive shield case surrounding the body; and a first terminal group arrayed in a line in the body. The first terminal group includes a first terminal and a second terminal. The second terminal is disposed adjacent to the first terminal and having a smaller impedance than the first terminal. The shield case includes an adjacent portion that is adjacent to at least a portion of the second terminal on an opposite side to the first terminal. At least one of the portion of the second terminal and the adjacent portion of the shield case is reduced in width so as to increase a distance between said portion of the second terminal and the adjacent portion of the shield case in accordance with an impedance difference between the first terminal and the second terminal.

In the connector according to the second aspect, at least one of the portion of the second terminal and the adjacent portion of the shield case is reduced in width so as to increase a distance between the portion of the second terminal and the adjacent portion of the shield case in accordance with an impedance difference between the first terminal and the second terminal, so that the adjacent portion of the shield case functions as a pseudo-GND terminal. Advantageously, the invention makes it possible to raise the impedance of the second terminal without adding a dummy GND terminal. The impedance matching can be thus conducted between the first and second terminals.

When the adjacent portion is adjacent to the entire second terminal, at least one of the second terminal and the adjacent portion of the shield case may be reduced in width so as to increase the distance between the second terminal and the adjacent portion of the shield case in accordance with an impedance difference between the first terminal and the second terminal. This case also produce the same effect as the connector according to the second aspect.

The first and second terminals may form a differential pair. In this case, the first and second terminals have matched impedances, so that time differences (skew) are unlikely to occur in signal transmission to the first and second terminals and the influence of the common mode noise superimposed on the first and second terminals does not appear asymmetrically as in the conventional example. The invention therefore makes it possible to cancel the common mode noise at the receiver and thereby prevent the degradation in high frequency characteristics and in transmission characteristics.

In a case where the second terminal is located at the extreme end of the first terminal group, a sidewall of the shield case positioned on the outer side of the first terminal group may be used as the adjacent portion. In this case, as the sidewall of the shield case can be used as a pseudo-GND terminal in the connector according to the first or second aspect of the invention, it is possible to match impedances of the first and second terminals without complicating the configuration of the connector.

The first terminal group may include two second terminals arranged at its opposite ends. The shield case may include a first adjacent portion, which is adjacent to at least said portion of one of the two second terminals, and a second adjacent portion, which is adjacent to said portion of the other second terminal. If the distance between the one of the second terminals and the first adjacent portion is larger than the distance between the other second terminal and the second adjacent portion, at least said portion of the one of the second terminals may be further extended in width than the other second terminal. By thus individually adjusting the degree of widthwise extension of the second terminals at ends in accordance with the distance between each second terminal and adjacent portion, the invention makes it possible to substantially equalize the impedance characteristics of all the first and second terminals.

The first terminal group may include two second terminals arranged at its opposite ends. The shield case may include a first adjacent portion, which is adjacent to at least said portion of one of the two second terminals, and a second adjacent portion, which is adjacent to said portion of the other second terminal. If the distance between the one of the second terminals and the first adjacent portion is smaller than the distance between the other second terminal and the second adjacent portion, at least said portion of the one of the second terminals may be further reduced in width than the other second terminal. By thus individually adjusting the degree of widthwise extension of the second terminals at ends in accordance with the distance between each second terminal and adjacent portion, the invention makes it possible to substantially equalize the impedance characteristics of all the first and second terminals.

The first and second terminals may each include an intermediate portion having a generally downward L-shaped shape and being embedded in the body, a contact portion continued to a distal end of the intermediate portion, and a tail portion continued to a proximal end of the intermediate portion. The intermediate portion of the second terminal may include a distal end portion and a proximal end portion, the proximal end portion being bent to be inclined to the distal end portion. The proximal end portion may be said portion of the second terminal.

The connector according to the first or second aspect of the invention may further include a second terminal group. The second terminal group may be arrayed in a line, flush with the first terminal group, and spaced apart from the first terminal group.

The shield case may include a partition for partitioning between the first terminal group and the second terminal group. The partition may be adjacent to the second terminal so as to function as the adjacent portion. As the partition, a portion of the shield case, can be used as a pseudo-GND terminal, it is possible to match impedances of the first and second terminals without complicating the configuration of the connectors according to the first and second aspects.

BRIEF DESCRIPTION OF DRAWINGS

FIG. 1A is a perspective view seen from an upper right front side, and FIG. 1B is a perspective view seen from a lower right rear side.

FIG. 7A is a perspective view seen from the upper right rear side, and FIG. 7B is a perspective view seen from the lower right front side.

FIG. 8A is a perspective view seen from the upper right rear side, and FIG. 8B is a perspective view seen from the lower right front side.

DESCRIPTION OF EMBODIMENTS

Hereinafter, a connector according to an embodiment of the present invention will be described with reference to FIGS. 1A to 8B. The connector shown in FIGS. 1A and 1B and 2A and 2B is a receptacle connector adapted to be mounted on a circuit board 10 of an electronic device. The connector is connectable with a Micro USE 2.0 plug connector (hereinafter referred to as USB 2.0 plug) and/or a Micro USB 3.0 plug connector (hereinafter referred to as USB 3.0 plug), not shown. The receptacle connector includes a body 100, a USB 2.0 compliant terminal group 200*a* (second terminal group), a USB 3.0 compliant terminal group 200*b* (first terminal group), and a shield case 300. Each of these components will be described below in detail.

Figure 1A:
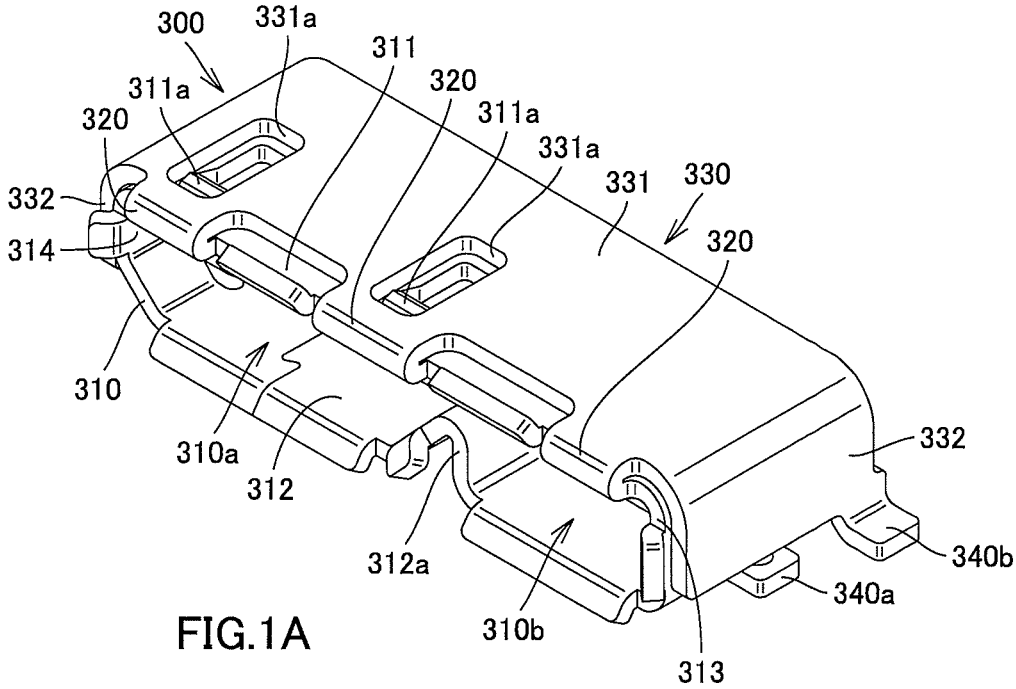
FIGS. 1A and 1B are schematic views of a connector according to an embodiment of the present invention, where
Figure 1B:
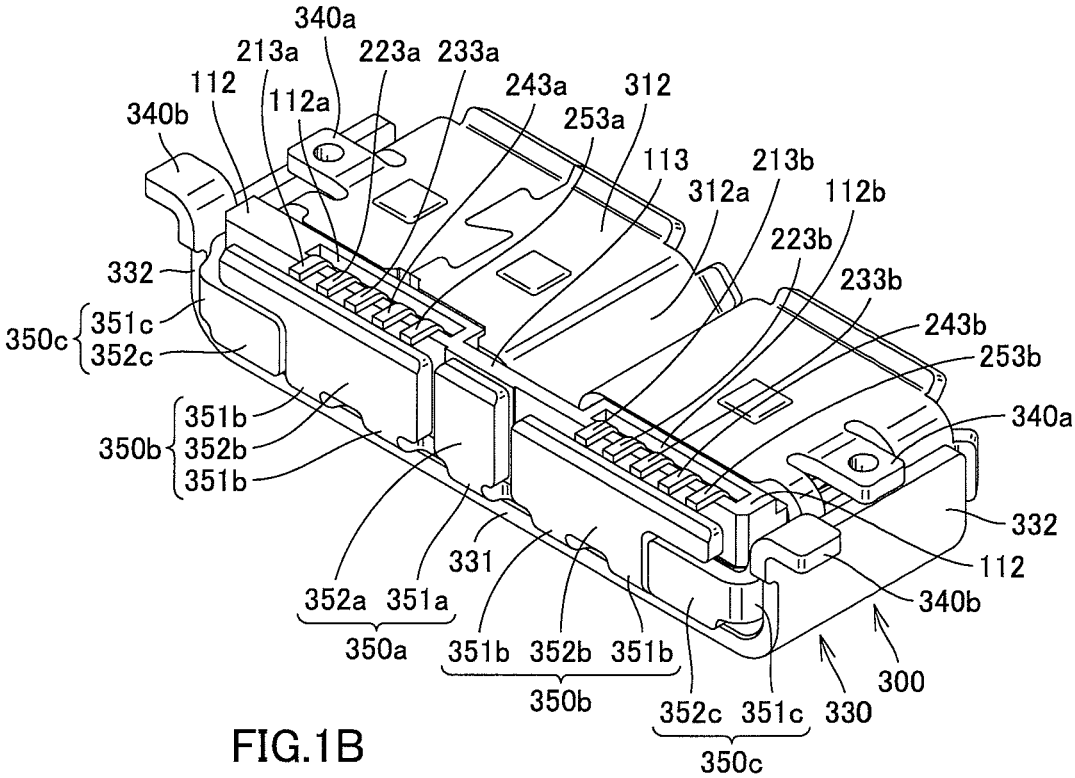
Figure 2A:
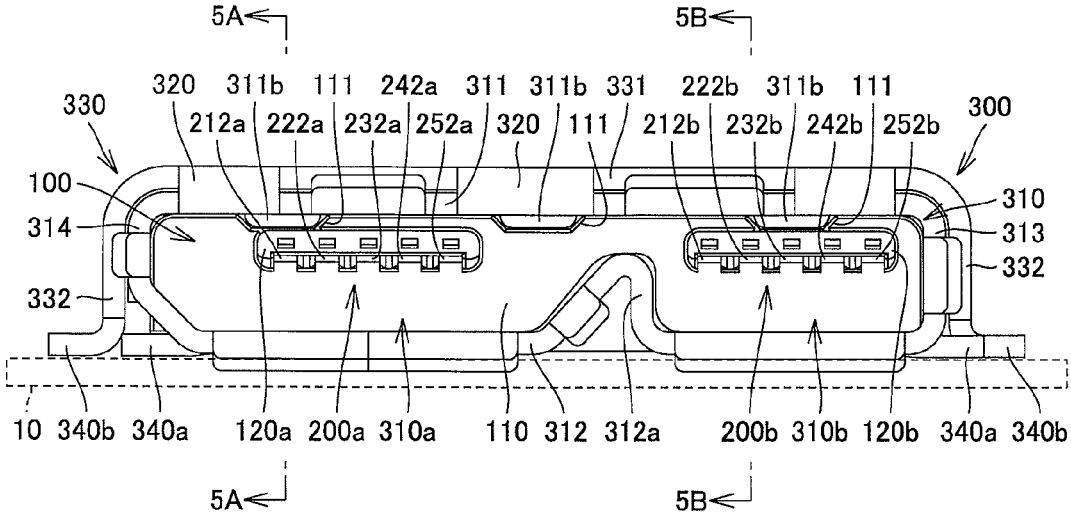
FIG. 2A is a schematic front view of the connector.

The shield case 300 is formed by press-forming a conductive metal plate. As shown in FIGS. 1A to 5B, the shield case 300 includes a housing 310, three folded-back parts 320, a cover 330, pairs of first and second connection pieces 340*a*, 340*b*, a first back cover 350*a*, a pair of second back covers 350*b*, and a pair of third back covers 350*c*. As shown in FIG. 2A, the housing 310 is a generally rectangular tuboid shell to surround the body 100. The housing 310 includes a top plate

Figure 3A:
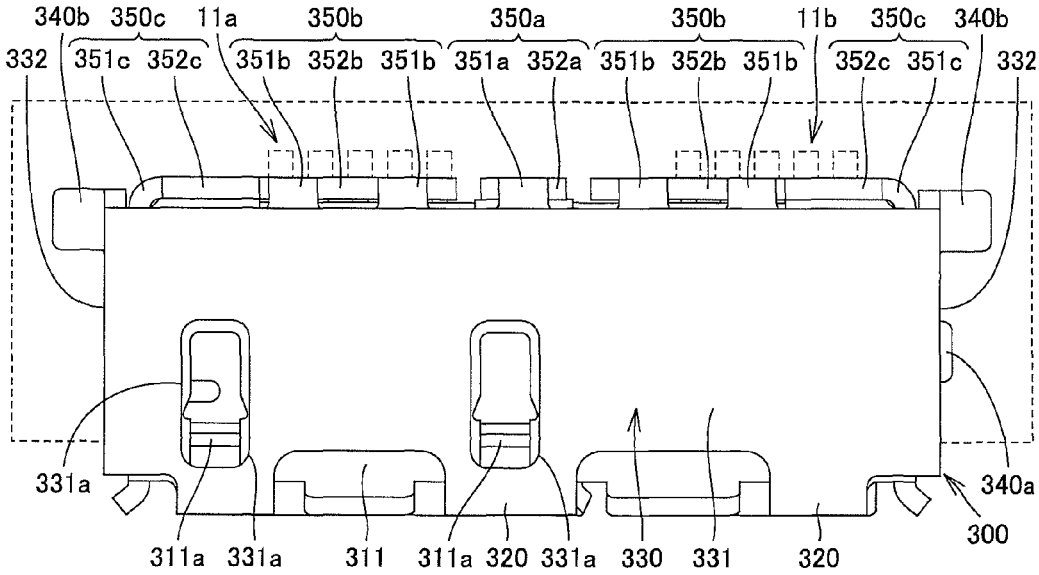
FIG. 3A is a schematic plan view of the connector.
Figure 3B:
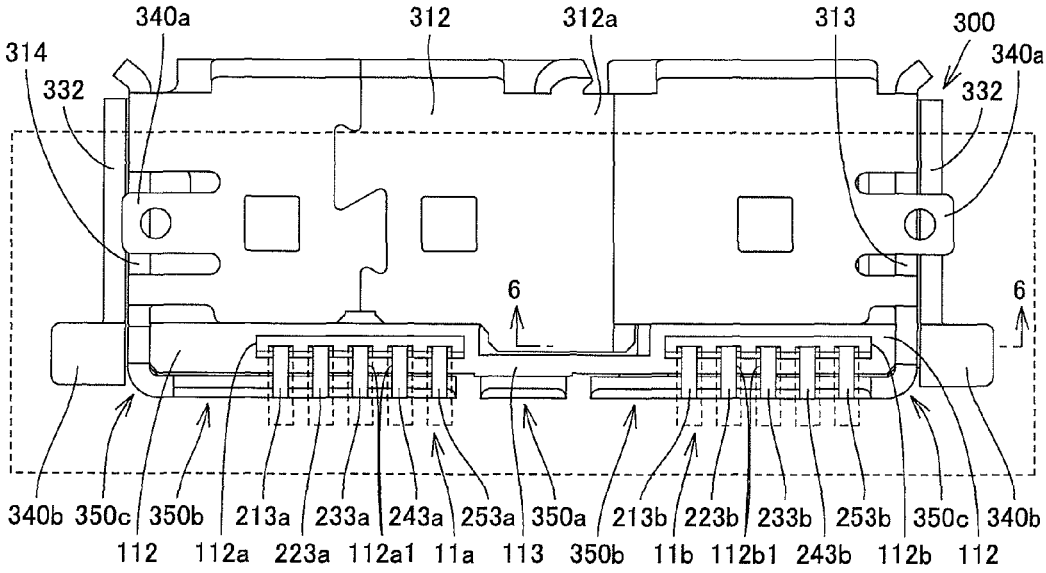
FIG. 3B is a schematic bottom view of the connector.
Figure 4A:
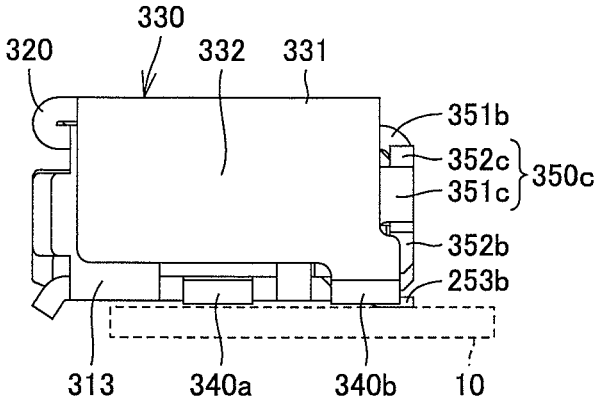
FIG. 4A is a schematic right side view of the connector.
Figure 4B:
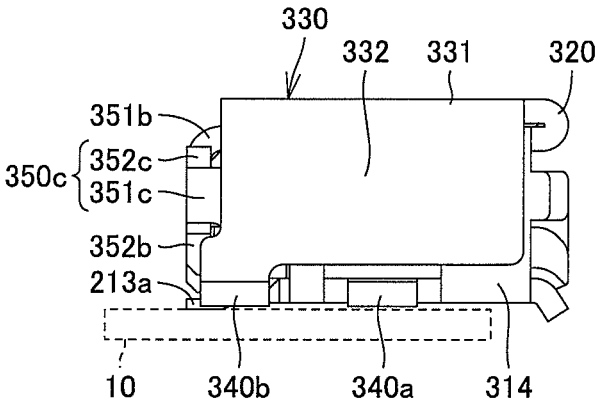
FIG. 4B is a schematic left side view of the connector.

311, a bottom plate 312, and sidewalls 313, 314. As shown in FIGS. 1A, 1B, 2A, and 3B, the bottom plate 312 is a generally square plate body with its central portion bent in a generally inverted V-shape folded toward the top plate 311. The bent portion forms a partition 312*a* for partitioning the inside of the housing 310 into first and second receiving holes 310*a*, 310*b*. The first receiving hole has an inner shape that conforms to the outer shape of the USB 2.0 plug, and the second receiving hole 310*b* has an inner shape that conforms to the outer shape of the USB 3.0 plug. In other words, the first receiving hole 310*a* is adapted to receive a USB 2.0 plug, and the second receiving hole 310*b* is adapted to receive a USB 3.0 plug. The bottom plate 312 has an inclined portion at its left side as illustrated in FIG. 2A. As shown in FIGS. 1B and 3B, the bottom plate 312 are cut and bent partly at its lengthwise ends to form the first connection pieces 340*a*. The first connection pieces 340*a* are plates that extend outward and flush with the bottom plate 312 to be connected by soldering to a first ground electrode on the circuit board 10. In other words, the first connection pieces 340*a* are mounting legs suitable for the surface mount technology (SMT).

Figure 5A:
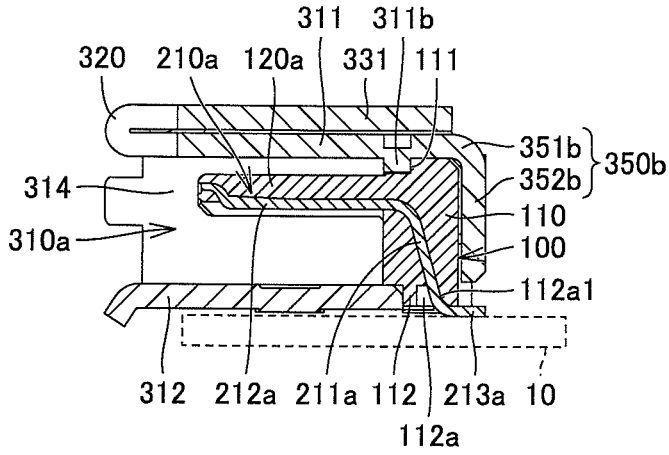
FIG. 5A is a schematic cross-sectional view taken along line 5A-5A of the connector.

As shown in FIGS. 2A and 2B and FIGS. 5A and 5B, the top plate 311 is a generally square plate disposed to face the bottom plate 312. As shown in FIGS. 1A and 3A, the top plate 311 is provided with a pair of cut-and-raised pieces 311*a* formed by cutting and raising portions of the top plate 311. At the back side of the top plate 311, three projections 311*b* project toward the bottom plate 312 as shown in FIGS. 2A and 5A. The top plate 311 and the bottom plate 312 is coupled at each end by each sidewalls 313, 314. The sidewall 313 is a generally square plate. The sidewall 314 is a generally square plate having a smaller height dimension than the sidewall 313. As shown in FIGS. 3A and 3B and FIGS. 4A and 4B, the fold-back parts 320 are each a plate body having a generally lateral U-shape in cross sectional view, wherein one end is continued to the center and the outer ends of the distal end of the top plate 311, and the other end is folded back towards the rear of the shield case 300. The other end of the folded-back part 320 is continued to the front of a central reinforcement plate 311 of the cover 330.

The cover 330 is a generally downward U-shaped plate as shown in FIGS. 1A and 1B and FIGS. 2A and 2B. The cover 330 includes the central reinforcement plate 311, and a pair of outer reinforcement plates 332. The central reinforcement plate 331 is a generally square plate having a larger width than the top plate 311, and it extends along the upper surface of the top plate 311. As shown in FIGS. 1A and 3A, the central reinforcement plate 331 is provided with a pair of long holes 331*a* of a generally square shape at positions corresponding to the cut-and-raised pieces 311*a* of the top plate 311. An end of each cut-and-raised piece 311*a* is inserted into each long hole 331*a*. As shown in FIGS. 2A and 2B and FIGS. 3A and 3B, the outer reinforcement plates 332 are generally square plates continued from the ends of the central reinforcement plate 331 and extending along outer surfaces of the sidewalls 313, 314. The lower end of each outer reinforcement plate 332 is provided with the second connection pieces 340*b* projecting outward. The second connection pieces 340*b* are plates bent substantially perpendicular to the outer reinforcement plate 332, and they are connected by soldering to a second ground electrode of the circuit board 10. In other words, the second connection pieces 340*a* are mounting legs suitable for the surface mount technology (SMT).

Figure 2B:
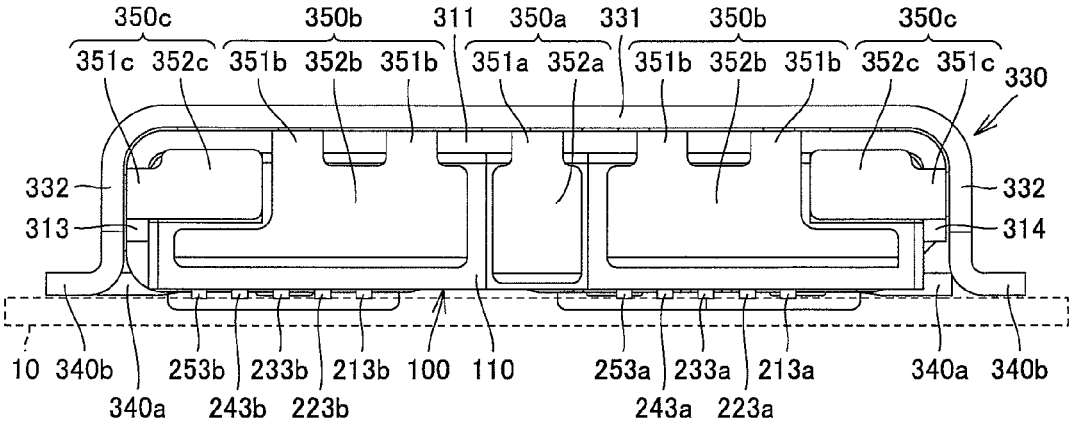
FIG. 2B is a schematic rear view of the connector.

As shown in FIGS. 1B and 2B, the first back cover 350*a* is continued to the central rear end of the top plate 311 of the housing 310. As shown in FIGS. 1B and 2B, the second back covers 350*b* are also continued to the rear end of the top plate 311 of the housing 310, but they are arranged outside the first back cover 350*a*. As shown in FIGS. 1B and 2B, the third back covers 350*c* are continued to the respective upper rear ends of the sidewalls 313, 314 of the housing 310. The first back cover 350*a* includes a bent portion 351*a* and a cover body 352*a*. The bent portion 351*a* is bent substantially perpendicular to the top plate 311, and the cover body 352*a* is a generally square plate continuing to the bent portion 351*a*. The cover body 352*a* extends along and in contact with the central portion of the rear face of the main body 110 of the body 100 accommodated in the housing 310. The second back covers 350*b* each include a pair of bent portions 351*b* and a cover body 352*b*, which is a generally L-shaped plate continuing to the bent portions 351*b*. The third back covers 350*c* each include a bent portion 351*c* and a cover body 352*c*, which is a generally square shaped plate continuing to the bent portion 351*c*. The bent portions 351*b* are bent substantially perpendicular to the top plate 311, and the bent portions 351*c* are bent substantially perpendicular to the sidewalls 313, 314. The cover bodies 352*b*, 352*c* extend along and in contact with outer end portions of the rear face of the main body 110 of the body 100 accommodated in the housing 310.

Figure 5B:
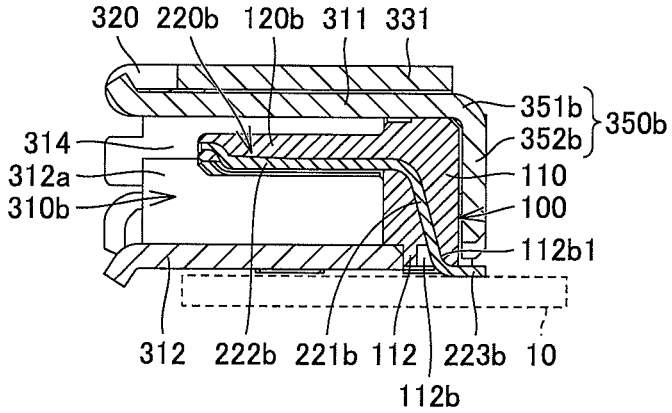
FIG. 5B is a schematic cross-sectional view taken along line 5B-5B of the connector.
Figure 7A:
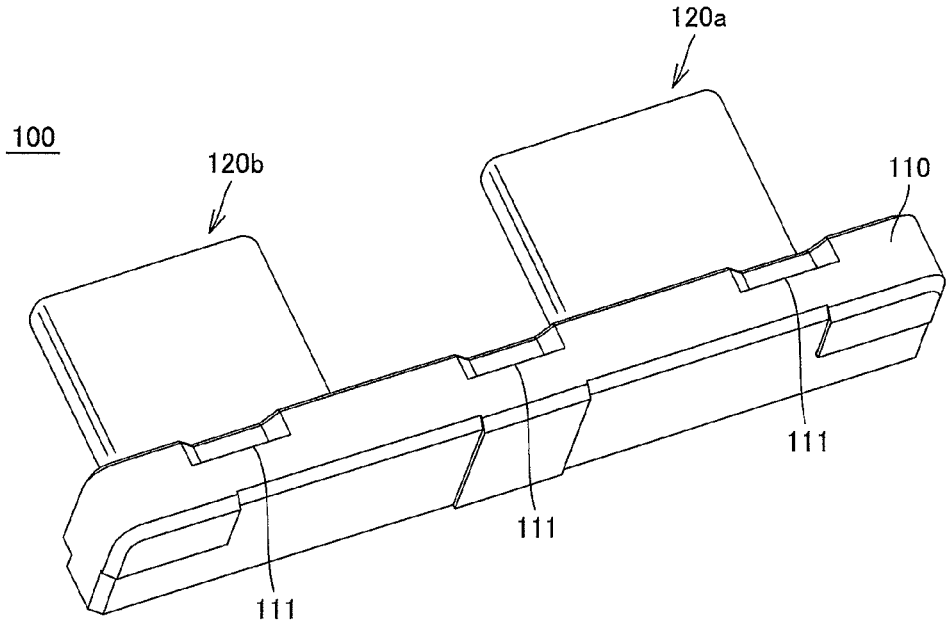
FIGS. 7A and 7B are schematic views of a body of the connector, where
Figure 7B:
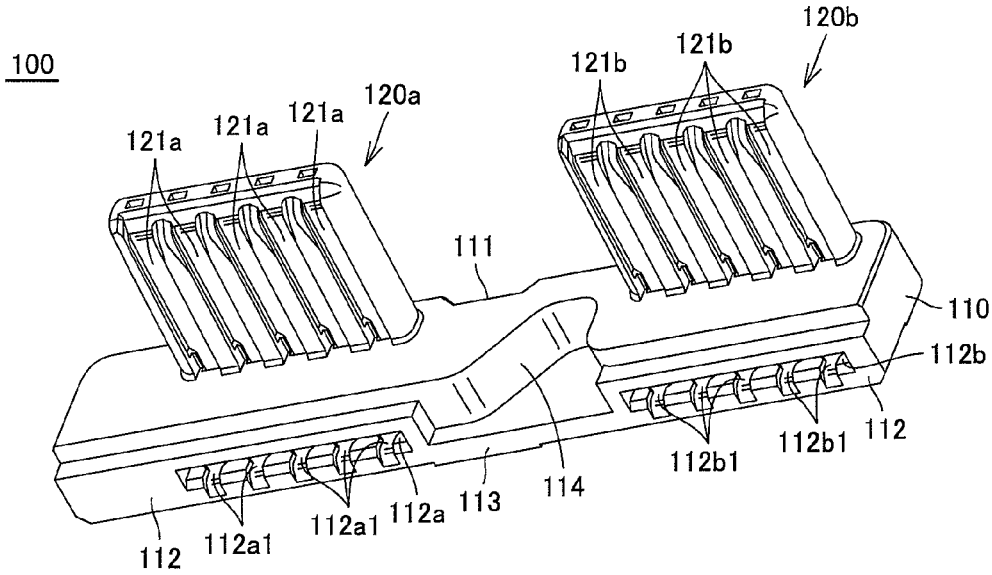

As shown in FIGS. 2A and 2B and FIGS. 7A and 7B, the body 100 is a molded article made of insulating resin. The body 100 includes the main body 110, and first and second projected parts 120*a*, 120*b*. The main body 110 is a plate-like body of generally square shape in cross sectional view, and it is accommodated in the housing 310 of the shield case 300. The upper end of the main body 110 is provided with three fitting recesses 111. The fitting recesses 111 are adapted to fittingly receive the projections 311*b* of the shield case 300. As shown in FIGS. 1B and 7B, a rear-side lower end of the main body 110 is provided with a pair of outer elongated protrusions 112 and a central elongated protrusion 113. The central elongated protrusion 113 is positioned between the outer elongated protrusions 112. A recess 114 is formed in the front center of the main body 110, as shown in FIG. 7B, to fit over the partition 312*a* of the bottom plate 312 of the shield case 300. The front surface of the outer elongated protrusions 112 abut the end portions of the rear end of the bottom plate 312 of the shield case 300, and the front surface of the central protrusion 113 abuts the rear end of the partition 312*a* received in the recess 114. As shown in FIG. 1B and FIGS. 5A and 5B, the cover bodies 352*a*, 352*b*, and 352*c* of the first, second, and third back covers 350*a*, 350*b*, and 350*c* are in contact with the rear face of the main body 110. In other words, the main body 110 is sandwiched between the projection 311*b* and the rear end of the bottom plate 312 of the shield case 300, and the cover bodies 352*a*, 352*b*, 352*c* of the first, second, and third back covers 350*a*, 350*b*, 350*c*. Square shaped lead-out holes 112*a*, 112*b* are formed in the respective lower surfaces of the outer elongated protrusions 112. Five lead-out grooves 112*a*1 are provided at spaced intervals in the wall at the back side of the lead-out hole 112*a*, and five lead-out grooves 112*b*1 are provided at spaced intervals in the wall at the back side of the lead-out hole 112*b*.

The first projected part 120*a* projects from a left portion (as seen in FIG. 2A) of the front surface of the main body 110, and the second projected part 120*b* projects from a right portion thereof. The first projected part 120*a* is a flat plate-like projection and is accommodated in the first receiving hole 310*a* of the housing 310 of the shield case 300, as shown in FIGS. 2A and 5A. As shown in FIG. 7B, the lower surface of the first projected part 120*a* has a plurality of long grooves 121*a*. The second projected part 120*b* is a flat plate-like projection and is accommodated in the second receiving hole 310*b* of the housing 310 of the shield case 300, as shown in FIGS. 2A and 5B. As shown in FIG. 7B, the lower surface of the second projected part 120*b* has a plurality of long grooves 121*b*. The terminal group 200*a* for USB 2.0 is embedded by insert molding at spaced intervals along the width of the above-mentioned left portion of the main body 110 and the first projected part 120*a*. The terminal group 200*b* for USB 3.0 is embedded by insert molding at spaced intervals and flush with the terminal group 200*a* along the width of the above-mentioned right portion of the main body 110 and the second projected part 120*b*. The partition 312*a* partitions between the terminal group 200*a* and the terminal group 200*b*.

Figure 8A:
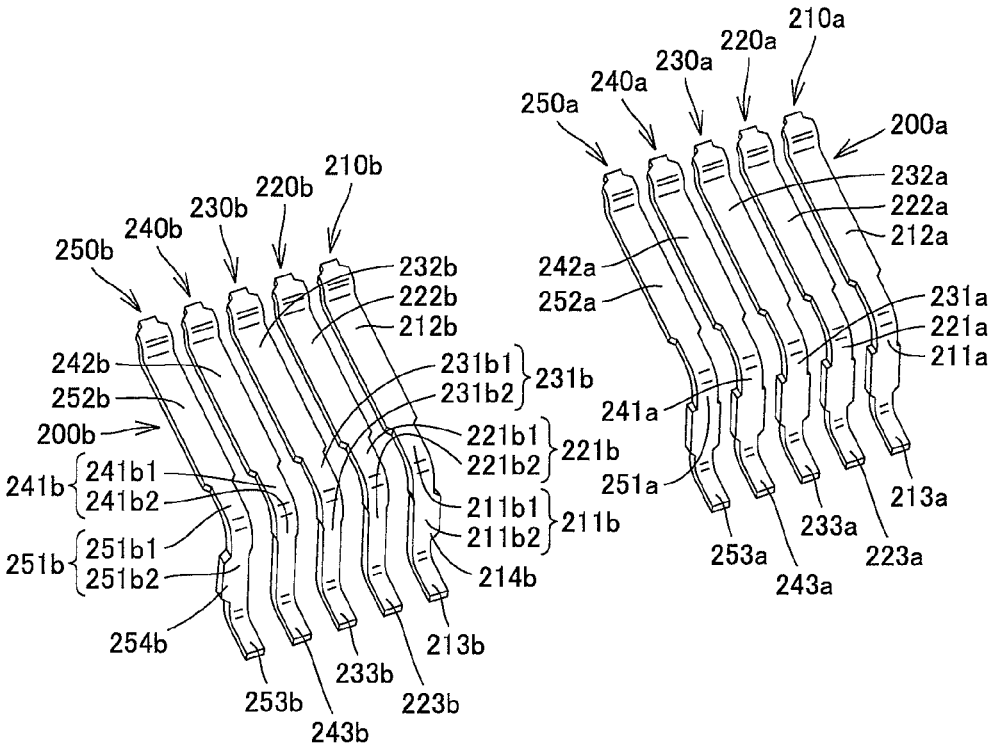
FIGS. 8A and 8B are schematic views of first and second terminal groups of the connector, where
Figure 8B:
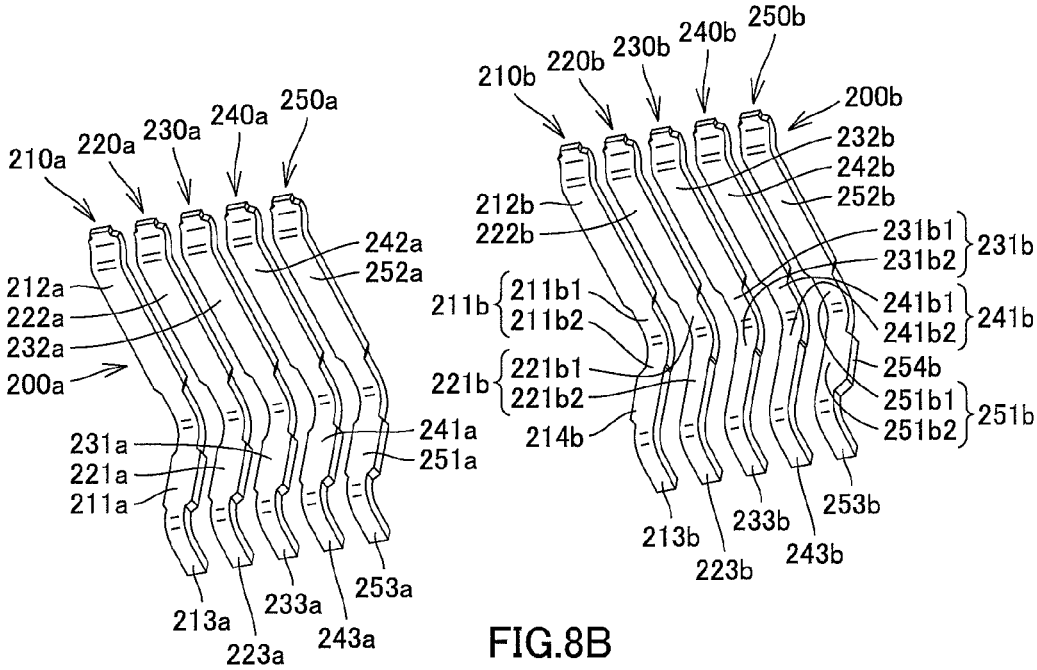

As shown in FIG. 2A and FIGS. 8A and 8B, the terminal group 200*a*, compliant with the USB 2.0 standard, includes a Vbus terminal 210*a*, a D− terminal 220*a* for negative data, a D+ terminal 230*a* for positive data, an ID terminal 240*a*, and a GND terminal 250*a*. The Vbus terminal 210*a*, the D− terminal 220*a*, the D+ terminal 230*a*, the ID terminal 240*a*, and the GND terminal 250*a* are arrayed in a line at spaced intervals in this order. The Vbus terminal 210*a*, the D− terminal 220*a*, the D+ terminal 230*a*, the ID terminal 240*a*, and the GND terminal 250*a* are substantially the same terminals, generally L-shaped elongated metal plates having conductivity. By way of example, the Vbus terminal 210*a* will be described in detail. The Vbus terminal 210*a* includes a generally L-shaped intermediate portion 211*a*, a contact portion 212*a* continuing to the distal end of the intermediate portion 211*a*, and a tail portion 213*a* continuing to the proximal end of the intermediate portion 211*a*. The intermediate portion 211*a* is embedded in the main body 110 of the body 100, and the proximal end of the intermediate portion 211*a* is projected downward from the lead-out hole 112*a* of the outer elongated protrusion 112 of the main body 110 and along the lead-out groove 112*a*1. The contact portion 212*a* is embedded in the first projected part 120*a*, and the lower end of the contact portion 212*a* is exposed from the long groove 121*a* of the first projected part 120*a*. The exposed portion is to be contacted by a terminal of a USB 2.0 plug. The tail portion 213*a* is extended rearward along the lower surface of the outer elongated protrusion 112 of the body 100. The tail portion 213*a* is to be connected by soldering to an electrode 11*a* of the circuit board 10. FIGS. 8A and 8B also illustrate an intermediate portion 221*a* of the D− terminal 220*a*, a contact portion 222*a* of the D− terminal 220*a*, and a tail portion 223*a* of the D− terminal 220*a*; an intermediate portion 231*a* of the D+ terminal 230*a*, a contact portion 232*a* of the D+ terminal 230*a*, and a tail portion 233*a* of the D+ terminal 230*a*; an intermediate portion 241*a* of the ID terminal 240*a*, a contact portion 242*a* of the ID terminal 240*a*, and a tail portion 243*a* of the ID terminal 240*a*; and an intermediate portion 251*a* of the GND terminal 250*a*, a contact portion 252*a* of the GND terminal 250*a*, and a tail portion 253*a* of the GND terminal 250*a*. The GND terminal 250*a* is grounded by soldering its tail portion 253*a* to an electrode 11*a* of the circuit board 10.

As shown in FIGS. 8A and 8B, the terminal group 200*b*, compliant with the USB 3.0 standard, includes an RX+ terminal 210*b* (second terminal), an RX− terminal 220*b* (first terminal), a GND terminal 230*b*, a TX+ terminal 240*b* (first terminal), and a TX− terminal 250*b* (second terminal). The RX+ terminal 210*b*, the RX− terminal 220*b*, the GND terminal 230*b*, the TX+ terminal 240*b*, and the TX− terminal 250*b* are arrayed in a line at spaced intervals in this order. The RX+ terminal 210*b* and the RX− terminal 220*b* form a differential pair of a reception system, and the TX+ terminal 240*b* and the TX− terminal 250*b* form a differential pair of a transmission system. The RX− terminal 220*b*, the GND terminal 230*b*, and the TX+ terminal 240*b* are substantially the same terminals, generally L-shaped elongate metal plates having conductivity. By way of example, The RX− terminal 220*b* will be described in detail. The RX− terminal 220*b* includes a generally L-shaped intermediate portion 221*b*, a contact portion 222*b* continuing to the distal end of the intermediate portion 221*b*, and a tail portion 223*b* continuing to the proximal end of the intermediate portion 221*b*. The intermediate portion 221*b* includes a distal end portion 221*b*1 and a proximal end portion 221*b*2 embedded in the main body 110 of the body 100. The proximal end portion 221*b*2 is bent so as to be inclined with respect to the distal end portion 221*b*1, and the proximal end of the proximal end portion 221*a*2 projects downward from the lead-out hole 112*b* of the outer elongated protrusion 112 of the main body 110 and along the lead-out groove 112*b*1. The contact portion 222*b* is continued to the distal end of the distal end portion 221*a*1. The contact portion 222*b* is embedded in the second projected part 120*b*, and the lower end of the contact portion 222*b* is exposed from the long groove 121*b* of the second projected part 120*b*. The exposed portion is to be contacted by a terminal of a USB 3.0 plug. The tail portion 223*b* is extended rearward along the lower surface of the outer elongated protrusion 112 of the body 100. The tail portion 213*b* is to be connected by soldering to an electrode 11*b* of the circuit board 10. FIGS. 8A and 8B also illustrate an intermediate portion 231*b* of the GND terminal 230*b*, a distal end portion 231*b*1 and a proximal end portion 231*b*2 of the intermediate portion 231*b*, a contact portion 232*b* of the GND terminal 230*b*, and a tail portion 233*b* of the GND terminal 230*b*. The GND terminal 230*b* is grounded by soldering the tail portion 233*b* to the electrode 11*b* of the circuit board 10. FIGS. 8A and 8B also illustrate an intermediate portion 241*b* of the ID terminal 240*a*, a distal end portion 241*b*1 and a proximal end portion 241*b*2 of the intermediate portion 241*b*, a contact portion 242*a* of the ID terminal 240*a*, and a tail portion 243*a* of the ID terminal 240*a*.

The RX+ terminal 210*b* and the TX− terminal 250*b* are conductive metal plates having substantially the same shape as the RX− terminal 220*b* and the other terminals, except that terminals 210*b* and 250*b* include widened parts 214*b*, 254*b*, respectively (to be described). FIGS. 8A and 8B illustrate an intermediate portion 211*b* of the RX+ terminal 210*b*, a distal end portion 211*b*1 and a proximal end portion 211*b*2 of the intermediate portion 211*b*, a contact portion 212*b* of the RX+ terminal 210*b*, and a tail portion 213*b* of the RX+ terminal 210*b*; an intermediate portion 251*b* of the TX− terminal 250*b*, a distal end portion 251*b*1 and a proximal end portion 251*b*2 of the intermediate portion 251*b*, a contact portion 252*a* of the TX− terminal 250*b*, and a tail portion 253*a* of the TX− terminal 250*b*. Since the RX+ terminal 210*b* and the TX− terminal 250*b* are positioned at opposite ends (i.e., extreme ends) of the terminal group 200*b*, there is no contact adjacent to and outside the RX+ terminal 210*b* or the TX− terminal 250*b*. Therefore, the RX+ terminal 210*b* has a higher impedance than the RX− terminal 220*b*, and the TX− terminal 250*b* has a higher impedance than the TX+ terminal 240*b*. Mismatched impedances thus occur between the RX+ terminal 210*b* and the RX− terminal 220*b*, which form a differential pair, and between the TX− terminal 250*b* and the TX+ terminal 240*b*, which form another differential pair. Consequently, impedance matching should be made between the RX+ terminal 210*b* and the RX− terminal 220*b*, and between the TX− terminal 250*b* and the TX+ terminal 240*b*.

Figure 6:
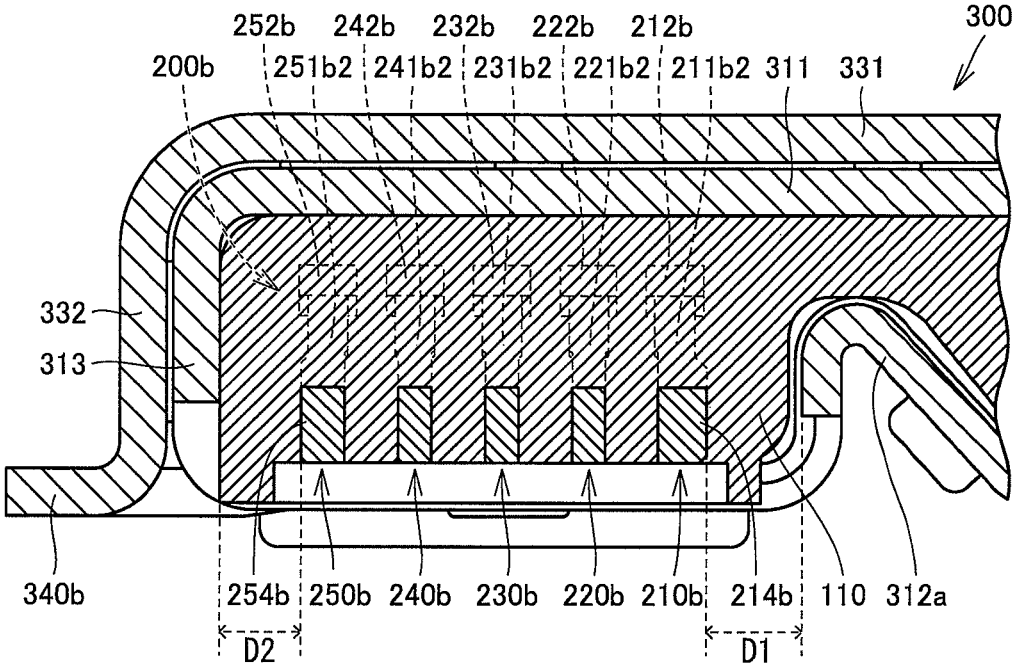
FIG. 6 is a schematic cross-sectional view taken along line 6-6 of the connector.

In order to conduct impedance matching in the present receptacle connector, the proximal end portion 211*b*2 of the RX+ terminal 210*b* has a widened width as shown in FIG. 6, so that the distance between the proximal end portion 211*b*2 (a portion of second terminal) of the intermediate portion

211*b* of the RX+ terminal 210*b* and the partition 312*a* (first adjacent portion) of the shield case 300 adjacent to the proximal end portion 211*b*2 at the outer side (i.e., opposite side to RX− terminal 220*b*) of the terminal group 200*b* becomes smaller in accordance with the impedance difference between the RX+ terminal 210*b* and the RX− terminal 220*b*. In other words, by widening the end (widened part 214*b*) on the partition 312*a* side of the proximal end portion 211*b*2 of the RX+ terminal 210*b* toward the partition 312*a*, the distance between the widened part 214*b* and the partition 312*a* is made smaller in accordance with the impedance difference between the RX+ terminal 210*b* and the RX− terminal 220*b*, so that the partition 312*a* functions as a pseudo-GND terminal. With the pseudo-GND terminal existing on the outer side of the RX+ terminal 210*b*, the impedance of the RX+ terminal 210*b* is lowered, achieving matched impedances between the RX+ terminal 210*b* and the RX− terminal 220*b*. Similarly, the proximal end portion 251*b*2 of the TX− terminal 250*b* has a widened width, so that the distance between the proximal end portion 251*b*2 (a portion of second terminal) of the intermediate portion 251*b* of the TX− terminal 250*b* and the sidewall 313 (second adjacent portion) of the shield case 300 adjacent to the proximal end portion 251*b*2 on the outer side (i.e., opposite side to TX+ terminal 240*b*) of the terminal group 200*b* becomes smaller in accordance with the impedance difference between the TX− terminal 250*b* and the TX+ terminal 240*b*. In other words, by widening the end (widened part 254*b*) on the sidewall 313 side of the proximal end portion 251*b*2 of the TX− terminal 250*b* toward the sidewall 313, the distance between the widened part 254*b* and the sidewall 313 is made smaller in accordance with the impedance difference between the TX− terminal 250*b* and the TX+ terminal 240*b*, so that the sidewall 313 functions as a pseudo-GND terminal. With the pseudo-GND terminal existing on the outer side of the TX− terminal 250*b*, the impedance of the TX− terminal 250*b* is lowered, achieving matched impedances between the TX− terminal 250*b* and the TX+ terminal 240*b*. It should be noted that the distance D1 between the proximal end portion 211*b*2 of the RX+ terminal 210*b* and the partition 312*a* is larger than the distance D2 between the proximal end portion 251*b*2 of the TX− terminal 250*b* and the sidewall 313, and hence the widened part 214*b* has a larger width than the widened part 254*b*. As a result, all the terminals of the terminal group 200*b* is set substantially the same in impedance characteristics.

The receptacle connector is configured as described above and assembled in the following steps. The first step is to prepare the body 100 having the terminal groups 200*a*, 200*b* insert molded therein. Also prepared is the shield case 300 in a state before the bent portions 351*a*, 351*b*, 351*c* of the first, second, and third back covers 350*a*, 350*b*, 350*c* are bent. The prepared body 100 is then inserted into the housing 310 of the shield case 300 from its rear opening. Upon the insertion, the first and second projected parts 120*a*, 120*b* of the body 100 are inserted into the first and second receiving holes 310*a*, 310*b*, respectively, of the housing 310. When the body 100 is further inserted into the housing 310 of the shield case 300, the projections 311*b* of the shield case 300 are fitted into the fitting recesses 111 of the main body 110 of the body 100, the outer elongated protrusions 112 of the body 100 are brought into contact with opposite ends of the bottom plate 312 of the shield case 300, and the central protrusion 113 of the body 100 is brought into contact with the partition 312*a* of the shield case 300. Thereafter, the bent portions 351*a*, 351*b*, 351*c* of the first, second, and third back covers 350*a*, 350*b*, 350*c* are bent at a substantially right angle, and the cover bodies 352*a*, 352*b*, 352*c* of the first, second, and third back covers 350*a*, 350*b*, 350*c* are brought into contact with the rear face of the main body 110 of the body 100.

The receptacle connector is thus assembled and is to be mounted on the circuit board 10 in the following manner. First, the first and second connection pieces 340*a*, 340*b* of the shield case 300 are placed on the first and second ground electrodes, and the tail portions 213*a*, 223*a*, 233*a*, 243*a*, 253*a* of the terminal group 200*a* are placed on the electrodes 11*a* of the circuit board 10, and the tail portions 213*b*, 223*b*, 233*b*, 243*b*, 253*b* of the terminal group 200*b* are placed on the electrodes 11*b* of the circuit board 10. Thereafter, the first and second connection pieces 340*a*, 340*b* are respectively connected to the first and second ground electrodes of the circuit board 10 by soldering, the tail portions 213*a*, 223*a*, 233*a*, 243*a*, 253*a* of the terminal group 200*a* are connected to the respective electrodes 11*a* of the circuit board 10 by soldering, and the tail portions 213*b*, 223*b*, 233*b*, 243*b*, 253*b* of the terminal group 200*b* are connected to the respective electrodes 11*b* of the circuit board 10 by soldering.

The assembled receptacle connector is connectable to a USE 2.0 plug and/or a USB 3.0 plug in the following manner. When inserting a USB 2.0 plug into the first receiving hole 310*a* of the housing 310 of the shield case 300, terminals of the USB 2.0 plug are brought into contact with the respective contact portions 212*a*, 222*a*, 232*a*, 242*a*, 252*a* of the terminal group 200*a* exposed from the long grooves 121*a* of the first projected part 120*a* of the body 100. The USB 2.0 plug is thus connected to the receptacle. When a USB 3.0 plug is inserted into the second receiving hole 310*b* of the housing 310 of the shield case 300, terminals of the USB 3.0 plug are brought into contact with the respective contact portions 212*b*, 222*b*, 232*b*, 242*b*, 252*b* of the terminal 200*b* exposed from the long groove 121*b* of the second projected part 120*b* of the body 100. The USB 3.0 is thus connected to the receptacle.

In the above-described receptacle connector, the widened part 214*b* is provided at the proximal end portion 211*b*2 of the RX+ terminal 210*b* in order to shorten the distance between the widened part 214*b* and the partition 312*a* in accordance with the impedance difference between the RX+ terminal 210*b* and the RX− terminal 220*b*, so that the partition 312*a* functions as a pseudo-GND terminal. In other words, since the pseudo GND terminal exists on the outer vacant side of the RX+ terminal 210*b*, the impedance of the RX+ terminal 210*b* is lowered to match the impedances between the RX+ terminal 210*b* and the RX− terminal 220*b*. Further, the widened part 254*b* is provided at the proximal end portion 251*b*2 of the TX− terminal 250*b* in order to shorten the distance between the widened part 254*b* and the sidewall 313 in accordance with the impedance difference between the TX− terminal 250*b* and the TX+ terminal 240*b*, so that the sidewall 313 functions as a pseudo-GND terminal. In other words, since the pseudo-GND terminal exists on the outer vacant side of the TX− terminal 250*b*, the impedance of the TX− terminal 250*b* is lowered to match the impedances between the TX− terminal 250*b* and the TX+ terminal 240*b*. Therefore, time differences (skew) are unlikely to occur in signal transmission to the RX+ terminal 210*b* and the RX− terminal 220*b* and the influence of the common mode noise superimposed on the RX+ terminal 210*b* and the RX− terminal 220*b* does not appear asymmetrically. It is therefore possible to prevent the degradation in high frequency characteristics and in transmission characteristics. Similarly, time differences (skew) are unlikely to occur in signal transmission to TX− terminal 250*b* and the TX+ terminal 240*b* and the influence of the common mode noise superimposed on TX− terminal 250*b* and the TX+ terminal 240*b* does not appear asymmetrically. It is therefore possible to prevent the degradation in high frequency characteristics and in transmission characteristics.

Moreover, the cover 330 of the shield case 300 is disposed along the top plate 311 and the sidewalls 313, 314 of the housing 310. In other words, the shield case 300 has a double-layer structure: a first layer of the top plate 311 and the sidewalls 313, 314 of the housing 310 and a second layer of the central reinforcement plate 331 and the outer reinforcement plates 332 of the cover 330. Having such a double-layer structure, the shield case 300 is unlikely to warp, particularly at the top plate 311 of the receiving portion 310, even if a prying force in the circumferential direction is applied on the receptacle by a USB 2.0 plug inserted into the first receiving hole 310*a* of the receiving portion 310 of the shield case 300, or by a USB 3.0 plug inserted into the second receiving hole 310*b* of the receiving portion 310. In summary, the shield case 300 of the present receptacle has an advantageously high prying resistance.

The above-described receptacle connector is not limited to the above embodiment but can be modified in design within the scope described in the claims. Some modification examples will be described in detail below.

In the above-described embodiment, the proximal end portion 211*b*2 of the RX+ terminal 210*b* is extended in width in order to shorten the distance between the proximal end portion 211*b*2 of the intermediate portion 211*b* of the RX+ terminal 210*b* and the partition 312*a* of the shield case 300 adjacent to the proximal end portion 211*b*2 at the outer side of the terminal group 200*b* in accordance with the impedance difference between the RX+ terminal 210*b* and the RX− terminal 220*b*. However, any design changes can be made as long as at least a portion of the second terminal and/or the adjacent portion of the shield case is extended in width in order to shorten the distance between the second terminal and the adjacent portion of the shield case adjacent to at least the portion of the second terminal in accordance with the impedance difference of the first and second terminals that are adjacent to each other. For example, the distance can be made shorter by bending a portion of the partition 312*a* toward the RX+ terminal 210*b* in accordance with the impedance difference. Alternatively, the distance can be made shorter by bending both a portion of the partition 312*a* and the proximal end portion 221*a*2 of the RX+ terminal 210*b* in the directions closer to each other in accordance with the impedance difference. Width extension can be made at any area as desired. In cases where the adjacent portion is adjacent to the entire second terminal, the second terminal and/or the adjacent portion of the shield case can be extended in width so that the distance between the second terminal and the adjacent portion of the shield case becomes shorter in accordance with the impedance difference of the first and second terminals that are adjacent to each other. Modifications described in this paragraph can be similarly applied to the TX− terminal 250*b* and the sidewall 313.

In cases where the second terminal has a lower impedance than the first terminal (e.g., case where the distance from the sidewall of the shield case to the second terminal is shorter than the distance between the first and second terminals due to miniaturization of the connector), at least a portion of the second terminal and/or the adjacent portion of the shield case may be reduced in width in order to shorten the distance between the second terminal and the adjacent portion of the shield case adjacent to at least the portion of the second terminal in accordance with the impedance difference between the first and second terminals that are adjacent to each other. For example, the proximal end portion 211*b*2 of the RX+ terminal 210*b* may have a recess or the like at its outer end in order to increase the distance between the proximal end portion 211*b*2 of the RX+ terminal 210*b* and the partition 312*a* in accordance with the impedance difference between the RX+ terminal 210*b* and the RX− terminal 220*b*. In this case as well, it is possible to match the impedances between the RX+ terminal 210*b* and the RX− terminal 220*b*. In a case where the distance between the proximal end portion 211*b*2 of the RX+ terminal 210*b* and the partition 312*a* is smaller than the distance between the proximal end portion 251*b*2 of the TX− terminal 250*b* and the sidewall 313, the proximal end portion 211*b*2 of the RX+ terminal 210*b* may be further reduced than the proximal end portion 251*b*2 of the TX− terminal 250*b*. Width reduction can be made at any area as desired. In cases where the adjacent portion is adjacent to the entire second terminal, the second terminal and/or the adjacent portion of the shield case can be reduced in width in order to increase the distance between the second terminal and the adjacent portion of the shield case in accordance with the impedance difference of the first and second terminals that are adjacent to each other.

The first and second terminals described above may constitute a differential pair as with the RX+ terminal 210*b* and the RX− terminal 220*b*, but they may not constitute a differential pair. The adjacent portion adjacent to at least a portion of the second terminal of the shield case is not limited to the partition 312*a* or the sidewall 313. It is possible to assign as the adjacent portion any appropriate portion that is adjacent to at least the portion of the second terminal.

The connector may have two terminal groups 200*a* and 200*b*, but it should have one terminal group at a minimum. The connector of the above-described embodiment is a receptacle connector, but the invention may be applied to a plug connector.

The shield case 300 of the above-described embodiment has the housing 310, three folded-back parts 320, the cover 330, the pair of first and second connection pieces 340*a*, 340*b*, the first back cover 350*a*, the pair of second back covers 350*b*, and the pair of third back covers 350*c*. However, the shield case may be modified in shape as long as it is adapted to surround the body. Furthermore, the shield case 300 may be or may not be a conductive metal plate. For example, the shield case may be formed by vapor-depositing metal on an inner surface of a resin case surrounding the body. The first and second connection pieces 340*a*, 340*b* may be mounting legs suitable for SMT as in the embodiment. However, the first and second connection pieces 340*a*, 340*b* may be legs of dual inline package (DIP) type to be inserted into and connected to through-holes formed in the circuit board 10.

The materials, shapes, numbers, dimensions, etc. constituting the connector of the above embodiment are described as examples only. The materials, etc. may be modified as long as they can provide similar functions.

REFERENCE SIGNS LIST

10 circuit board
11*a* electrode
11*b* electrode
100 body
110 main body
  111 fitting recess
  112 outer elongated protrusion
  113 central protrusion
120*a* first projected part
120*b* second projected part
200*a* USB 2.0 compliant terminal group (second terminal group)

210*a* Vbus terminal
220*a* D− terminal
230*a* D+ terminal
240*a* ID terminal
250*a* GND terminal
200*b* USB 3.0 compliant terminal group (first terminal group)
210*b* RX+ terminal (second terminal)
214*b* widened part
220*b* RX− terminal (first terminal)
230*b* GND terminal
240*b* TX+ terminal (first terminal)
250*b* TX− terminal (second terminal)
254*b* widened part
300 shield case
310 housing
311 top plate
312 bottom plate
312*a* partition (first adjacent portion)
313 sidewall (second adjacent portion)
314 sidewall
320 folded-back part
330 cover
340*a* first connection piece
340*b* second connection piece
350*a* first back cover
350*b* second back cover
350*c* third back cover

The invention claimed is:

1. A connector comprising:
a body having insulating properties;
a conductive shield case surrounding the body; and
a first terminal group arrayed in a line in the body; wherein the first terminal group includes:
a first terminal, and
a second terminal disposed adjacent to the first terminal and having a higher impedance than the first terminal,
the shield case includes an adjacent portion that is adjacent to at least a portion of the second terminal and on an opposite side to the first terminal; and
at least one of the portion of the second terminal and the adjacent portion of the shield case is extended in width so as to shorten a distance between the portion of the second terminal and the adjacent portion of the shield case in order to match an impedance of the first terminal and an impedance of the second terminal.

2. The connector according to claim 1, wherein the first and second terminals form a differential pair.

3. The connector according to claim 1, wherein
the second terminal is located at an extreme end of the first terminal group; and
the adjacent portion comprises a sidewall of the shield case, the sidewall being located outside the first terminal group.

4. The connector according to claim 1, further comprising a second terminal group, the second terminal group being arrayed in a line, flush with the first terminal group, and spaced apart from the first terminal group.

5. The connector according to claim 4, wherein the shield case includes a partition for partitioning between the first terminal group and the second terminal group, the partition being adjacent to the second terminal so as to function as the adjacent portion.

6. A connector comprising:
a body having insulating properties;
a conductive shield case surrounding the body; and
a first terminal group arrayed in a line in the body, wherein the first terminal group includes:
a first terminal, and
a second terminal disposed adjacent to the first terminal and having a higher impedance than the first terminal,
the shield case includes an adjacent portion that is adjacent to the entire second terminal and on an opposite side to the first terminal, and
at least one of the second terminal and the adjacent portion of the shield case is extended in width so as to shorten a distance between the second terminal and the adjacent portion of the shield case to match an impedance of the first terminal and an impedance of the second terminal.

7. A connector comprising:
a body having insulating properties;
a conductive shield case surrounding the body; and
a first terminal group arrayed in a line in the body, wherein the first terminal group includes:
a first terminal, and
two second terminals arranged at opposite ends of the first terminal group and adjacent to the first terminal, the second terminals having a higher impedance than the first terminal,
the shield case includes:
a first adjacent portion, which is adjacent to at least a portion of one of the two second terminals and on an opposite side to the first terminal, and
a second adjacent portion, which is adjacent to a portion of the other second terminal and on an opposite side to the first terminal,
said portion of the one of the second terminals is extended in width so as to shorten a distance between said portion of the one of the second terminals and the first adjacent portion of the shield case to match an impedance of the first terminal and an impedance of the one of the second terminals,
said portion of the other second terminal is extended in width so as to shorten a distance between said portion of the other second terminal and the second adjacent portion of the shield case to match an impedance of the first terminal and an impedance of the other second terminal,
the distance between the one of the second terminals and the first adjacent portion is larger than the distance between the other second terminal and the second adjacent portion, and
at least said portion of the one of the second terminals is further extended in width than the other second terminal.

8. A connector comprising:
a body having insulating properties;
a conductive shield case surrounding the body; and
a first terminal group arrayed in a line in the body, wherein the first terminal group includes:
a first terminal and
a second terminal disposed adjacent to the first terminal and having a higher impedance than the first terminal;
the first and second terminals each include:
an intermediate portion having a generally downward L-shaped shape and being embedded in the body, the intermediate portion of the second terminal including a distal end portion and a proximal end portion, the proximal end portion being bent to be inclined to the distal end portion,
a contact portion continued to a distal end of the intermediate portion, and
a tail portion continued to a proximal end of the intermediate portion, the shield case includes an adjacent portion that is adjacent to the proximal end portion of the second terminal and on an opposite side to the first terminal; and at least one of the proximal end portion of the second terminal and the adjacent portion of the shield case is extended in width so as to shorten a distance between the proximal end portion of the second terminal and the adjacent portion of the shield case to match an impedance of the first terminal and an impedance of the second terminal.

9. A connector comprising:

a body having insulating properties;

a conductive shield case surrounding the body; and a first terminal group arrayed in a line in the body, wherein the first terminal group includes:

two first terminals, and two second terminals being arranged at opposite ends of the first terminal group, one of the second terminals being adjacent to one of the first terminals and having a higher impedance than the one of the first terminals, the other second terminal being adjacent to the other first terminal and having a higher impedance than the other first terminal, the shield case includes:

a first adjacent portion that is adjacent to at least a portion of one of the two second terminals and on an opposite side to the one of the first terminals, and a second adjacent portion that is adjacent to a portion of the other second terminal and on an opposite side to the other first terminal, said portion of the one of the second terminals is extended in width so as to shorten a distance between said portion of the one of the second terminals and the first adjacent portion of the shield case to match an impedance of the one of the first terminals and an impedance of the one of the second terminals, said portion of the other second terminal is extended in width so as to shorten a distance between said portion of the other second terminal and the second adjacent portion of the shield case to match an impedance of the other first terminal and an impedance of the other second terminal, the distance between the one of the second terminals and the first adjacent portion is larger than the distance between the other second terminal and the second adjacent portion, and at least said portion of the one of the second terminals is further extended in width than the other second terminal.

* * * * *